US005352266A

United States Patent [19]

Erb et al.

[11] Patent Number: 5,352,266

[45] Date of Patent: Oct. 4, 1994

[54] NANOCRYSTALLINE METALS AND PROCESS OF PRODUCING THE SAME

[75] Inventors: Uwe Erb, Glenburnie; Abdelmounam M. El-Sherik, Kingston, both of Canada

[73] Assignee: Queen'University at Kingston, Kingston, Canada

[21] Appl. No.: 983,205

[22] Filed: Nov. 30, 1992

[51] Int. Cl.[5] ..... C25D 3/12

[52] U.S. Cl. ..... 75/300; 75/710; 75/954; 205/50; 205/104; 205/105; 205/271; 205/272; 205/274

[58] Field of Search ..... 205/50, 104, 105, 271, 205/272, 274; 423/138; 156/101, 621; 75/300, 710, 954

[56] References Cited

U.S. PATENT DOCUMENTS 4,461,680 7/1984 Lashmore ..... 205/104

OTHER PUBLICATIONS

Gong et al., J. Appl. Phys. 69, 5119–5121; 1991.

*Primary Examiner*—Kathryn Gorgos

[57] ABSTRACT

A process for producing nanocrystalline materials, and in particular nanocrystalline nickel having an average grain size of less than about 11 nanometers is described. The nanocrystalline material is electrodeposited onto the cathode in an aqueous acidic electrolytic cell by application of a pulsed D.C. current. The cell electrolyte also contains a stress reliever, such as saccharin, which helps to control the grain size. The novel product of the invention find utility as wear resistant coatings, hydrogen storage materials, magnetic materials and as catalysts for hydrogen evolution.

17 Claims, 2 Drawing Sheets

NANOCRYSTALLINE METALS AND PROCESS OF PRODUCING THE SAME

FIELD OF INVENTION

This invention relates to nanocrystalline metals and methods of production thereof, and more particularly to the production of nanocrystalline nickel having a grain size of less than 11 nanometers.

BACKGROUND OF INVENTION

Nanocrystalline materials are a new class of disordered solids which have a large volume fraction (50% or more of the atoms) of defect cores and strained crystal lattice regions. The physical reason for the reduced density and the non-lattice spacing between the atoms in the boundary cores is the misfit between the crystal lattice of different orientation along common interfaces. The nanocrystalline system preserves in the crystals a structure of low energy at the expense of the boundary regions which are regions at which all of the misfit is concentrated so that a structure far away from equilibrium is formed (Gleiter, Nanocrystalline Materials, Prog. in Matls Science, Vol 33, pp 223–315, 1989). A structure of similar heterogeneity is not formed in thermally induced disordered solids such as glasses. Nanocrystalline materials typically have a high density ($10^{19}$ per $cm^3$) of grain interface boundaries. In order to achieve such a high density, a crystal of less than about 10 0 nm diameter is required. Over the past few years, great efforts to make smaller and smaller nanocrystals, down to about 10 nm have been made. It would appear, however, that the properties of even smaller nanocrystals (less than 10 nm) offer significant advantages over larger nanocrystals, particularly in the area of hardness, magnetic behavior hydrogen storage, and wear resistance.

Nanocrystalline materials, which are also known as ultrafine grained materials, nanophase materials or nanometer-sized crystalline materials, can be prepared in several ways such as by sputtering, laser ablation, inert gas condensation, oven evaporation, spray conversion pyrolysis, flame hydrolysis, high speed deposition, high energy milling, sol gel deposition, and electrodeposition. Each of these methods has its special advantages and disadvantages and not all methods are suitable for all types of nanocrystalline materials. It is becoming apparent, however, that electrodeposition is the method of choice for many materials. The major advantages of electrodeposition include (a) the large number of pure metals, alloys and composites which can be electroplated with grain sizes in the nanocrystalline range, (b) the low initial capital investment necessary and (c) the large body of knowledge that already exists in the areas of electroplating, electrowinning and electroforming.

Using electrodepositing techniques, nanocrystalline electrodeposites of nickel and other metals and alloys have been produced over the years with ever smaller diameters down to the 10–20 nm range. Heretofore, it has not been possible to get sizes below about 10 nm diameter. Small crystal sizes increase the proportions of triple junctions in the material. It is known that room temperature hardness increases with decreasing grain size in accordance with the known Hall-Petch phenomenon. However, it has now been determined that as the number of triple junctions in the material increases, at about 20 nm down, there is a deviation from normal Hall-Petch behavior and hardness does not continue to increase as the grain size falls below a critical value. Indeed, it has now been shown that in pure nickel nanocrystalline materials the hardness reaches a peak in the 8–10nm range. Other materials even show a decrease in hardness as the grain size decreases below about 10 nm.

Nanocrystalline materials have improved magnetic properties compared to amorphous and conventional polycrystalline materials. Of particular importance is the saturation magnetization, which should be as high as possible regardless of grain size. However, previous studies on gas-condensed nanocrystalline nickel (Gong et al, *J. Appl. Phys* 69, 5119, (1991)) reported decreasing saturation magnetization with decreasing grain size. It would appear, however, that this phenomenon is associated with the method of production as electroplated nanocrystalline nickel in accordance with the present invention shows little change in saturation magnetization.

OBJECT OF INVENTION

An object of the present invention is to provide a novel pulsed electrodeposition process for making nanocrystalline materials of less than 11 nm in diameter.

Another object of the invention is to provide nanocrystalline nickel in the less than 11 nm diameter range having superior magnetic, hardness, wear and hydrogen storage properties. Yet another object is to provide an apparatus for producing very fine nanocrystalline materials by pulsed electrodeposition.

BRIEF STATEMENT OF INVENTION By one aspect of this invention, there is provided a process for electrodepositing a selected metallic material in nanocyrstalline form on a substrate comprising:

(a) providing an electrolytic cell having an anode and cathode;

(b) introducing an aqueous, acidic electrolyte containing ions of said selected metallic material into said electrolyte cell;

(c) maintaining said bath at a temperature in the range between about 55° and about 75° C.; and (d) passing a DC current, having a peak current density in the range between about 1.0 and about 3.0 $A/cm^2$, at pulsed intervals during which said current passes for a time period in the range of about 1.0 to about 5 milliseconds and does not pass for a time period in the range of about 30 to about 50 milliseconds between said anode and said cathode so as to deposit said selected metallic material in nanocrystalline form on said cathode.

By another aspect of this invention, there is provided a nanocrystalline metallic material having a grain size less than 11 nanometers having a hardness which is at a maximum in a size range of 8–10 nm, and saturation magnetization properties substantially equal to those of said metallic material in normal crystalline form.

By yet another aspect of this invention, there is provided an apparatus for producing a selected nanocrystalline metallic material having a grain size of less than about 10 nm, comprising:

(a) an electrolytic cell containing an anode and cathode (b) means to maintain said cell at a selected temperature (c) DC power means connected to said anode and cathode so as to pass a DC current through said cell; and (d) means to interrupt said current passing through said cell for selected periods of time.

DETAILED DESCRIPTION OF PREFERRED EMBODIMENTS

As noted hereinabove pulsed direct current electrodeposition has been found to produce superior nanocrystalline materials, and particularly nickel, having a grain size of less than about 11 nm.

Figure 1:
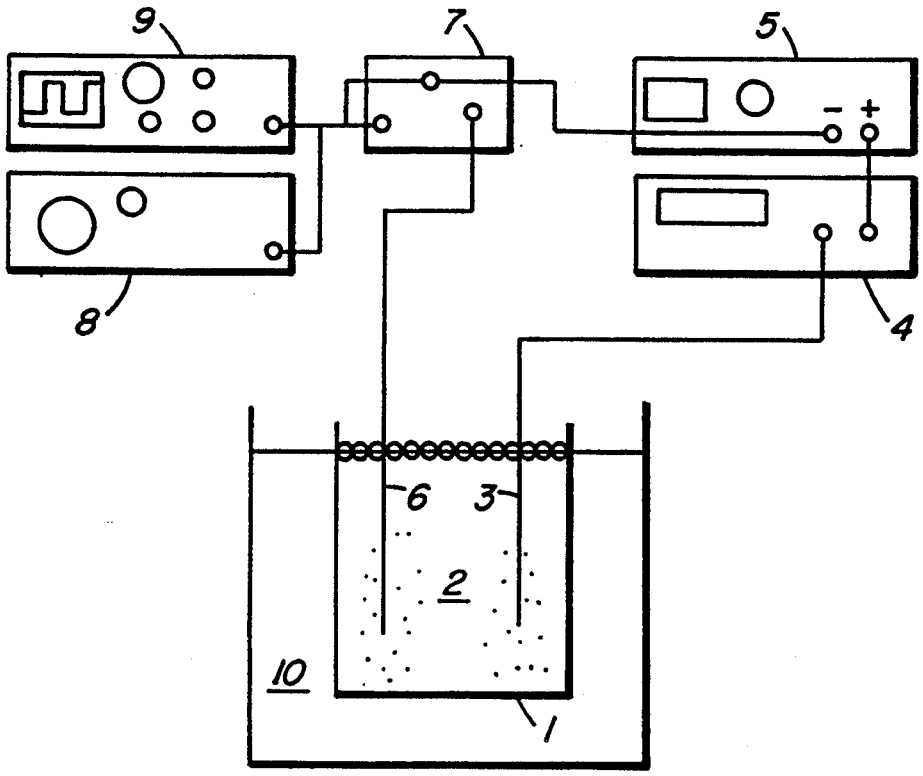
FIG. 1 is a diagrammatic sketch of one embodiment of an apparatus for use in the process of the present invention.

FIG. 1 is a sketch showing a laboratory apparatus for carrying the present invention into practice. A plating cell 1, generally of glass or thermoplastic construction, contains an electrolyte 2 comprising an aqueous acid solution of nickel sulfate, nickel chloride, boric acid and selected grain size inhibitors, grain nucleators and stress relievers, to be described in more detail hereinbelow. An anode 3 is connected to an ammeter 4 (Beckman, Industrial 310) in series connection to a conventional DC Power Source 5 (5 amp, 75 volt max output). The anode may be any dimensionally stable anode (DSA) such as platinum or graphite, or a reactive anode, depending on the material desired to be deposited. Preferably, in the case of nickel deposition, the anode is an electrolytic nickel anode. A cathode 6 is connected to the power source 5 via a transistored switch 7. Cathode 6 may be fabricated from a wide variety of metals such as steel, brass, copper and or nickel, or non-metal such as graphite. Preferably, cathode 6 is fabricated from titanium to facilitate stripping of the nickel deposited thereon. Switch 7 is controlled by a wave generator 8 (WaveTEK, Model 164) and the wave form is monitored on an oscilloscope 9 (Hitachi V212).

The temperature of the electrolyte 2 is maintained in the range between about 55° and 75° C. by means of a constant temperature bath 10 (Blue M Electric Co.). A preferred temperature range is about 60°–70° C. and most preferably about 65° C. The pH is controlled by additions such as $Ni_2CO_3$ powder or 7:1 $H_2SO_2$:HCl as required.

Figure 2:
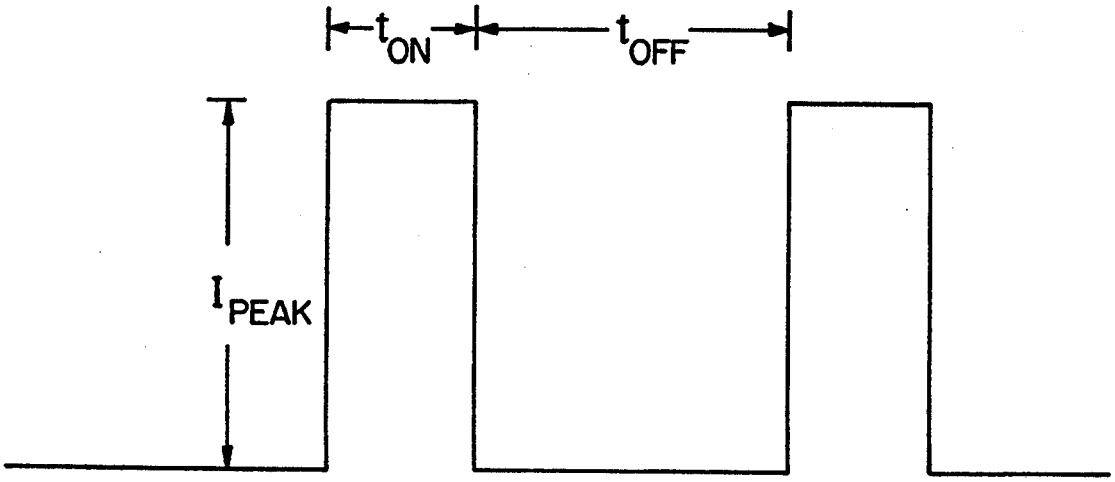
FIG. 2 is a graph illustrating current density versus time during a plating cycle.

The quality of the deposit and the crystalline structure thereof are functions of the peak current density in the cell 1, and the rate of pulsing the current. FIG. 2 illustrates the maximum current density ($I_{peak}$) as a function of time. It will be noted that generally the time off ($t_{off}$) is longer than the time on ($t_{on}$) and that the current density $I_{peak}$ may vary between about 1.0 A/cm$^2$ and about 3.0 A/cm$^2$. The $t_{on}$ may vary between about 1.0 and 5.0 msec., with a preferred range of 1.5–3.0 msec and an optimum value of 2.5 msec. The $t_{off}$ may range from about 30 msec. to 50 msec. with an optimum of 45 msec. It will be appreciated that $I_{peak}$, $t_{on}$ and $t_{off}$ are interrelated and may be varied within the stated ranges. If the $I_{peak}$ is too high, here is a risk that the deposited material will burn and if too low the grain size will increase.

In all of the following examples, which are illustrative only and not limiting on the invention, the electrolytic cell described above was employed with an electrolytic nickel anode and a titanium cathode and an aqueous electrolyte (Bath 1) containing:

Nickel Sulphate (BDH)=300 /l

Nickel Chloride (BDH)=45 gm/l

Boric Acid (BDH)=45 gm/1 in distilled water.

The pH was adjusted, as noted above, by addition of $NiCO_3$ powder or 7:1 $H_2SO_4$:HCL. The temperature was maintained at 65° C., for a standard plating time of 3 hours. Saccharin is a known stress reliever and grain refining agent and may be added in amounts up to about 10 gm/1. Other stress relievers and grain refining agents which may be added include coumarin and thiourea. If the bath temperature rises, it may be desirable to add a grain size inhibitor such as phosphorous acid in relatively small amounts up to about 0.5–1 gm/l.

EXAMPLE 1

Using the apparatus described with reference to FIG. 1 and a basic bath electrolyte composition described above as "Bath 1", 0.5 gm/l saccharin (Aldrich) was added and the pH adjusted to pH 2. The $I_{peak}$ was 1.9 A/cm$^2$ and $t_{on}$ was 2.5 m sec. and $t_{off}$ was 45 m sec. The result was a porosity free nanocrystalline nickel deposit of 0.250–0.300 mm thickness with an average grain size of 35 nm.

EXAMPLE 2

The procedure and operating conditions of Example 1 were repeated except that the saccharin concentration was increased to 2.5 gm/l. The result was a porosity free deposit of 0.220–0.250 mm thickness with an average grain size of 20 nm.

EXAMPLE 3

Example 1 was repeated except that the saccharin concentration was increased to 5 gm/l. The result was a porosity free deposit of 0.200 mm thickness with an average grain size of 11 nm.

EXAMPLE 4

Example 1 was repeated except that the pH was adjusted to pH 4.5 and the saccharin concentration was increased to 10 gm/l. The result was a porosity free deposit of 0.200–0.220 mm thickness with an average grain size of 6 nm.

EXAMPLE 5

Figure 3:
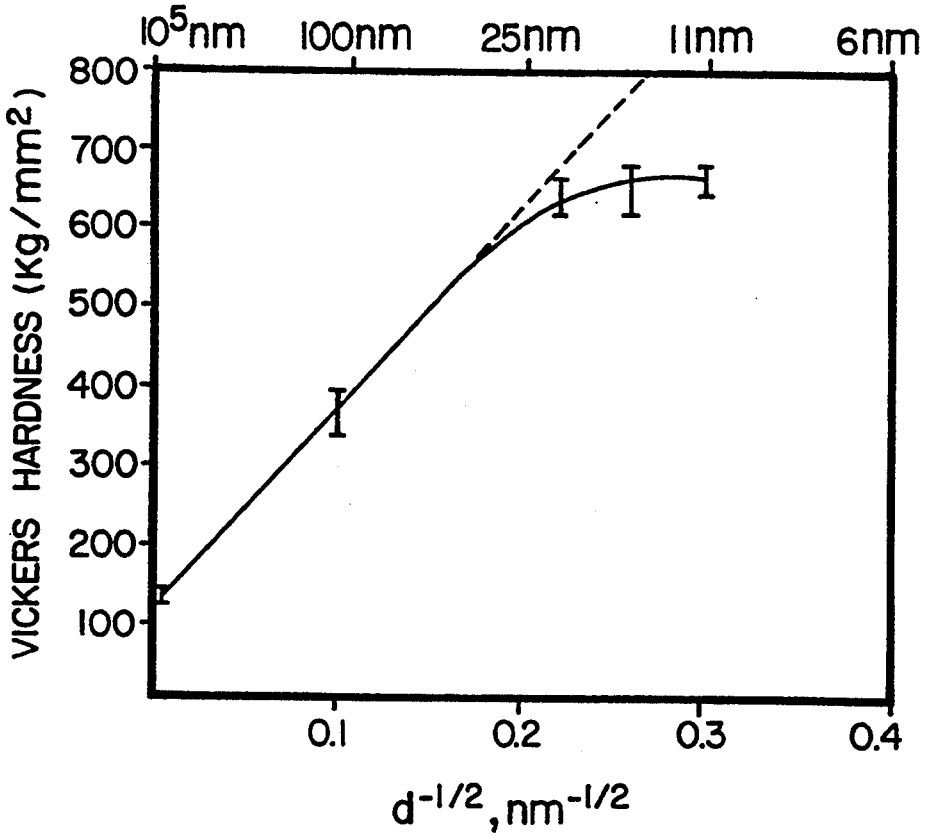
FIG. 3 is a graph of hardness (VHN) versus grain size for nanocrystalline nickel.

The products of Examples 1–3 were subjected to hardness testing using a standard Vickers hardness technique. The results are tabulated in FIG. 3 and illustrate that at the large grain sizes porosity free electroplated nickel nanocrystals obey the well established Hall-Petch relationship, i.e. increasing hardness with decreasing grain size. However, for the very small sizes of the present invention there is a clear deviation from the Hall-Petch relationship indicating a maximum hardness in the 8–10 nm size range.

EXAMPLE 6

Figure 4:
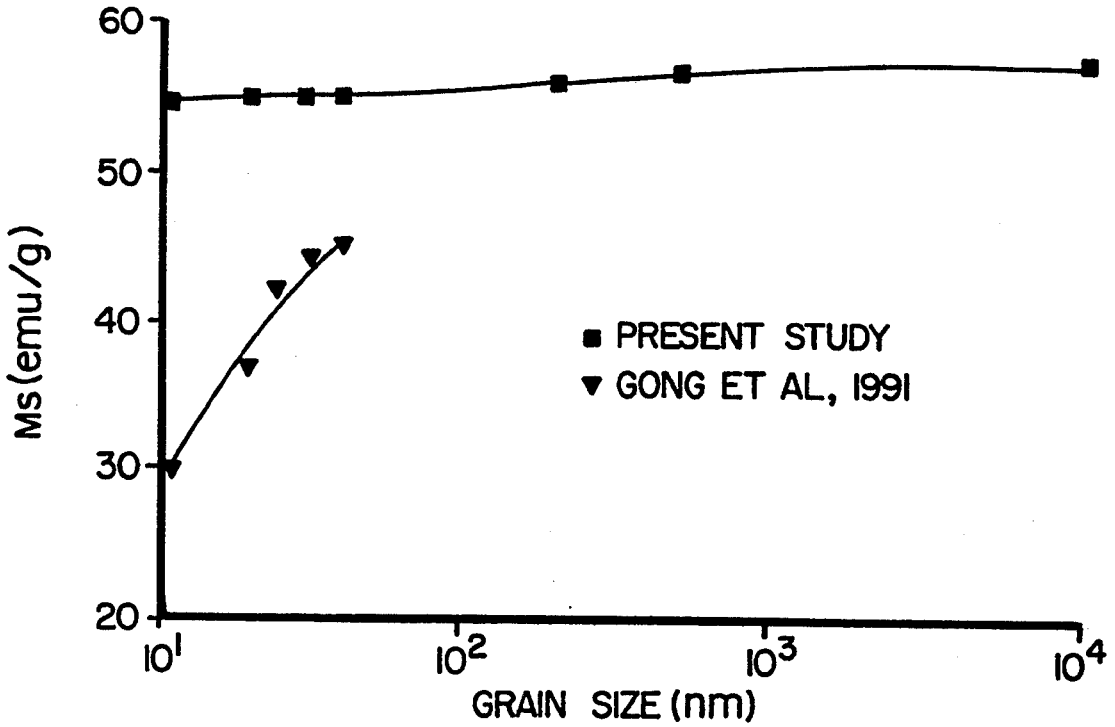
FIG. 4 is a graph of magnetic saturation (emu/g) versus grain size for nanocrystalline nickel produced according to the present invention, and compared to the prior art.

The saturation magnetization of the products of Examples 1–3 was measured using conventional methods. The results are tabulated in FIG. 4 and compared with the saturation magnetization of gas condensed nanocrystalline nickel as reported by Gong et at, supra. It will be noted that while Gong et al. report decreasing saturation magnetization with decreasing grain size, the products of the present show very little change in saturation magnetization with grain size variation, and even at the smallest grain sizes it is essentially the same as for conventional nickel.

The nanocrystalline materials of this invention, and particularly nanocrystalline nickel can be used to provide hard, wear resistant coatings on many surfaces. They can also be used as hydrogen storage materials, as catalysts for hydrogen evolution and magnetic materials.

We claim:

1. A process for electrodepositing a selected metallic material in nanocrystalline form on a substrate comprising:

(a) providing an electrolytic cell having an anode and cathode;

(b) introducing an aqueous, acidic electrolyte containing ions of said selected metallic material into said electrolytic cell;

(c) maintaining said electrolyte at a temperature in the range between about 55° and about 75° C.; and (d) passing a D.C. current, having a peak current density in the range between about 1.0 and about 3.0 A/cm$^2$, at pulsed intervals during which said current passes for a time period in the range of about 1.0 to about 5 milliseconds and does not pass for a time period in the range of about 30 to about 50 milliseconds, between said anode and said cathode so as to deposit said selected metallic material in nanocrystalline form on said cathode.

2. A process as claimed in claim 1 wherein said selected metallic material is nickel.

3. A process as claimed in claim 1 wherein said anode is selected from nickel, platinum and graphite.

4. A process as claimed in claim 3 wherein said cathode is selected form titanium, steel, brass, copper, nickel, and graphite.

5. A process as claimed in claim 4 wherein said electrolyte additionally contains up to about 10 g/l of a stress reliever and grain refining agent.

6. A process as claimed in claim 5 wherein said stress reliever and grain refining agent is selected from saccharin, coumarin and thiourea.

7. A process as claimed in claim 6 wherein said electrolyte additionally contains a grain size inhibitor.

8. A process as claimed in claim 7 wherein said grain size inhibitor is phosphorous acid.

9. A process as claimed in claim 2 wherein said current passes for periods between 1.5 and 3.0 milliseconds and does not pass for period between 40 and 50 milliseconds.

10. A process as claimed in claim 9 wherein said bath is maintained at a temperature in the range 60°-70° C.

11. A process as claimed in claim 10 wherein said current passes for 2.5 m sec and does not pass for 45 m sec.

12. A process as claimed in claim 11 wherein said bath is maintained at a temperature of 65° C.

13. A process as claimed in claim 9 wherein said peak current density is in the range 1.5–2.2 A/cm$^2$.

14. A process as claimed in claim 13 wherein said peak current density is about 1.9 A/cm$^2$.

15. Nanocrystalline nickel produced by the process of claim 1.

16. A nanocrystalline metallic material having an average grain size less than 5 nanometers having a hardness which is at a maximum in a size range of 8–10 nm, and saturation magnetization properties substantially equal to those of said metallic in normal crystalline form.

17. A nanocrystalline metallic material as claimed in claim 16 wherein said material is nickel.

* * * * *

UNITED STATES PATENT AND TRADEMARK OFFICE

CERTIFICATE OF CORRECTION

PATENT NO. : 5,352,266

DATED : October 4, 1994

INVENTOR(S) : U. Erb and Adelmounan M. El-Sherik

It is certified that error appears in the above-indentified patent and that said Letters Patent is hereby corrected as shown below:

At col 6 line 32, in claim 16 "average grain size less than 5 nanometers having a hard-"

should read

"average grain size less than 11 nanometers having a hard-"

Signed and Sealed this

Third Day of January, 1995

*Attest:*

*Attesting Officer*

BRUCE LEHMAN

*Commissioner of Patents and Trademarks*